US012797702B2

(12) United States Patent
Johnston

(10) Patent No.: US 12,797,702 B2
(45) Date of Patent: Nov. 17, 2026

(54) REMOVABLE WEIGHT FOR GOLF CLUB SHAFT

(71) Applicant: Topgolf Callaway Brands Corp., Carlsbad, CA (US)

(72) Inventor: Logan Johnston, La Mesa, CA (US)

(73) Assignee: Callaway Gold Company, Carlsbad, CA (US)

( * ) Notice: Subject to any disclaimer, the term of this patent is extended or adjusted under 35 U.S.C. 154(b) by 318 days.

(21) Appl. No.: 18/808,360

(22) Filed: Aug. 19, 2024

(65) Prior Publication Data

US 2024/0408464 A1 Dec. 12, 2024

Related U.S. Application Data

(62) Division of application No. 17/409,517, filed on Aug. 23, 2021, now Pat. No. 12,076,626.

(60) Provisional application No. 63/235,450, filed on Aug. 20, 2021.

(51) Int. Cl.
*A63B 60/24* (2015.01)
*A63B 53/14* (2015.01)

(52) U.S. Cl.
CPC ..... *A63B 60/24* (2015.10); *A63B 53/14* (2013.01)

(58) Field of Classification Search
CPC ..... A63B 60/24; A63B 53/14; A63B 60/02; A63B 60/52; A63B 2209/08; A63B 60/16
See application file for complete search history.

(56) References Cited

U.S. PATENT DOCUMENTS

2011/0300963 A1* 12/2011 Kim ..... A63B 69/3635 473/234
2012/0172142 A1* 7/2012 Yashiki ..... A63B 60/24 473/292

* cited by examiner

*Primary Examiner* — Jeffrey S Vanderveen
(74) *Attorney, Agent, or Firm* — Michael A. Catania; Daniel Moderick

(57) ABSTRACT

Golf club shaft assemblies with removable counterbalance weights are disclosed herein. In each embodiment, a shaft sleeve is secured within a butt end of a shaft and a weight is removably affixed to the shaft sleeve via locking structures, magnets, and/or spring devices.

6 Claims, 10 Drawing Sheets

REMOVABLE WEIGHT FOR GOLF CLUB SHAFT

CROSS REFERENCES TO RELATED APPLICATIONS

The Present Application is a divisional application of U.S. patent application Ser. No. 17/409,517, filed on Aug. 23, 2021, which claims priority to U.S. Provisional Application No. 63/235,450, filed on Aug. 20, 2021, the disclosure of each is hereby incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to removable weights for the butt end of a golf club shaft, and assemblies that permit easy removal and replacement of counterweighting for golf club shafts.

Description of the Related Art

Customizable golf club equipment has become increasingly popular among golfers, and in response, manufacturers and designers have devised various features to allow club fitters and golf club players to adjust certain characteristics of their clubs. Such characteristics include loft, lie, face angle, center of gravity (CG) location, club length, and shaft weight. There is a need for improved methods of quickly, inexpensively, and non-destructively adjusting the weight of a golf club shaft.

BRIEF SUMMARY OF THE INVENTION

One aspect of the present invention is a golf club shaft with removable counterbalance weighting, which may be secured within a butt end of the shaft by various means, including lock and key structures, magnets, and detent ball and springs.

Another aspect of the present invention is an assembly comprising a shaft comprising a shaft wall, a hollow interior, and a butt end, a shaft sleeve comprising a first head portion with a notch, a first extension portion, and a hollow through-hole, a weight comprising a second head portion, a second extension portion, and a plurality of tines extending radially from the elongated extension portion, and a disc spring, wherein the first extension portion is disposed within the hollow interior and bonded to the shaft wall so that the first head portion abuts the butt end of the shaft, wherein the second extension portion is disposed within the hollow through-hole so that each of the plurality of tines aligns with and fits within the notch, wherein the disc spring is disposed between the first head portion and the second head portion. In some embodiments, the plurality of tines may comprise three tines, each of which may be spaced approximately 120° from the other two tines. In another embodiment, the weight may be removed from the shaft sleeve by pulling the head portion of the sleeve apart so that the plurality of tines can be removed from the notch. In any embodiment, the disc spring may place pressure on a lower surface of the second head portion.

Yet another aspect of the present invention is an assembly comprising a shaft comprising a shaft wall, a hollow interior, and a butt end, a shaft sleeve comprising a first head portion with a notch, a first extension portion with a groove, and a hollow through-hole, a weight comprising a second head portion, a second extension portion with a shelf, and a plurality of tines extending radially from the elongated extension portion, and a spring c-clip, wherein the first extension portion is disposed within the hollow interior and bonded to the shaft wall so that the first head portion abuts the butt end of the shaft, wherein the second extension portion is disposed within the hollow through-hole so that each of the plurality of tines aligns with and fits within the notch, wherein the spring c-clip is disposed within the groove so that it encircles the second extension portion and abuts the shelf. In some embodiments, the plurality of tines may comprise three tines, each of which may be spaced approximately 120° from the other two tines. In another embodiment, the weight may be removed from the shaft sleeve by pulling the head portion of the sleeve apart so that the plurality of tines can be removed from the notch. In any of the embodiments, the spring c-clip may place pressure on the shelf.

Another aspect of the present invention is an assembly comprising a shaft comprising a shaft wall, a hollow interior, and a butt end, a shaft sleeve comprising a first head portion with a notch, a first extension portion with a first shelf and a groove disposed beneath the first shelf, and a hollow through-hole, a weight comprising a second head portion, a second extension portion with a second shelf, and a plurality of tines extending radially from the elongated extension portion, a c-clip, and a disc spring, wherein the first extension portion is disposed within the hollow interior and bonded to the shaft wall so that the first head portion abuts the butt end of the shaft and the first shelf aligns with the second shelf, wherein the second extension portion is disposed within the hollow through-hole so that each of the plurality of tines aligns with and fits within the notch, wherein the c-clip is disposed within the groove so that it encircles the second extension portion, and wherein the disc spring is disposed between the c-clip and the first and second shelves. In some embodiments, the plurality of tines may comprise three tines, each of which may be spaced approximately 120° from the other two tines. In another embodiment, the weight may be removed from the shaft sleeve by pulling the head portion of the sleeve apart so that the plurality of tines can be removed from the notch. In any of the embodiments, the disc spring may place pressure on the second shelf Another aspect of the present invention is an assembly comprising a shaft comprising a shaft wall, a hollow interior, and a butt end, a shaft sleeve comprising a first head portion with a notch and an upper surface, a first extension portion, and a hollow through-hole, a weight comprising a second head portion with at least one indent in a lower surface, a second extension portion, and a plurality of tines extending radially from the elongated extension portion, at least one anchoring magnet affixed to the upper surface of the first head portion, and at least one securing magnet affixed within the at least one indent, wherein the first extension portion is disposed within the hollow interior and bonded to the shaft wall so that the first head portion abuts the butt end of the shaft, wherein the second extension portion is disposed within the hollow through-hole so that each of the plurality of tines aligns with and fits within the notch, and wherein the at least one securing magnet is magnetically attracted to the at least one anchoring magnet to secure the weight to the shaft sleeve.

Yet another aspect of the present invention is an assembly comprising a shaft comprising a shaft wall, a hollow interior, and a butt end, a shaft sleeve comprising a first head portion with an upper surface, a first extension portion, and a hollow through-hole, a weight comprising a second head portion and a second extension portion, and at least one anchoring magnet affixed to the first head portion, wherein the first extension portion is disposed within the hollow interior and bonded to the shaft wall so that the first head portion abuts the butt end of the shaft, wherein the second extension portion is disposed within the hollow through-hole, and wherein the weight is composed of a ferrous material that is magnetically attracted to the at least one anchoring magnet to secure the weight to the shaft sleeve. In some embodiments, the at least one anchoring magnet may be affixed to the upper surface of the first head portion. In other embodiments, the first head portion may comprise an upper groove extending into the upper surface, and the at least one anchoring magnet may be disposed within the upper groove.

Another aspect of the present invention is an assembly comprising a shaft comprising a shaft wall, a hollow interior, and a butt end, a shaft sleeve composed of a first material comprising a first head portion with an upper surface, a first extension portion, and a hollow through-hole, and a weight composed of a second material comprising a second head portion and a second extension portion, wherein the first extension portion is disposed within the hollow interior and bonded to the shaft wall so that the first head portion abuts the butt end of the shaft, wherein the second extension portion is disposed within the hollow through-hole, and wherein second material is magnetically attracted to the first material to secure the weight to the shaft sleeve.

Another aspect of the present invention is an assembly comprising a shaft comprising a shaft wall, a hollow interior, and a butt end, a shaft sleeve comprising a first head portion, a first extension portion, a hollow through-hole, a first locking notch extending along the entire length of the shaft sleeve and facing the hollow through-hole, and a second locking notch disposed at and extending into an end of the first extension portion opposite the first head portion, and a weight comprising a second head portion, a second extension portion, and a keyed portion extending from the elongated extension portion proximate an end of the elongated extension portion opposite the second head portion, wherein the first extension portion is disposed within the hollow interior and bonded to the shaft wall so that the first head portion abuts the butt end of the shaft, wherein the weight is affixed to the shaft sleeve by sliding the keyed portion of the elongated extension portion into the first locking notch until the keyed portion exits the through-hole and then rotating the weight so that the keyed portion can fit within the second locking notch.

In some embodiments, the assembly may further comprise a disc spring, which may be disposed between the first head portion and the second head portion. In alternative embodiments, the assembly may further comprise an o-ring, which may be disposed between the first head portion and the second head portion. In a further embodiment, the second head portion may comprise a groove sized to at least partially receive the o-ring. In yet another alternative embodiment, the assembly may further comprise at least one anchoring magnet, which may be affixed to an upper surface of the first head portion. In a further embodiment, the weight may be composed of a ferrous material that is magnetically attracted to the at least one anchoring magnet. In an alternative, further embodiment, the assembly may further comprise at least one securing magnet, which may be disposed within at least one indent in the second head portion, and the at least one securing magnet may be magnetically attracted to the at least one anchoring magnet. In any embodiment, the second locking notch may be disposed approximately 90° from the first locking notch around the first extension portion.

Yet another aspect of the present invention is an assembly comprising a shaft comprising a shaft wall, a hollow interior, and a butt end, a shaft sleeve comprising a first head portion, a first extension portion, a hollow through-hole, and a groove proximate an end of the first extension portion opposite the first head portion, a weight comprising a second head portion, a second extension portion, and at least one notch extending into the elongated extension portion, and at least one detent ball and spring comprising a ball portion and a spring portion, wherein the first extension portion is disposed within the hollow interior and bonded to the shaft wall so that the first head portion abuts the butt end of the shaft, wherein the second extension portion is disposed within the hollow through-hole so that at least one notch aligns with the groove, and wherein the spring portion of the at least one detent ball and spring is disposed within the at least one notch so that the ball portion at least partially protrudes from the at least one notch into the groove.

In some embodiments, the at least one notch may comprise a plurality of notches extending radially into the second extension portion, and in a further embodiment, the at least one detent ball and spring may comprise a plurality of detent ball and springs. In another, further embodiment, the plurality of detent ball and springs may comprise three detent ball and springs, the plurality of notches may comprise three notches, and each detent ball and spring may be at least partially disposed within a notch.

In any of the embodiments disclosed above, the shaft may have an overall diameter ranging from 0.595 to 0.605 inch and the hollow through-hole may have a diameter ranging from 0.510 to 0.517 inch. Also in any of the embodiments, the weight may be composed of a high-density material, and may comprise tungsten. In any of the embodiments, the shaft sleeve may be composed of a lightweight material, including low density metal alloys or non-metal materials such as plastic or carbon composite.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
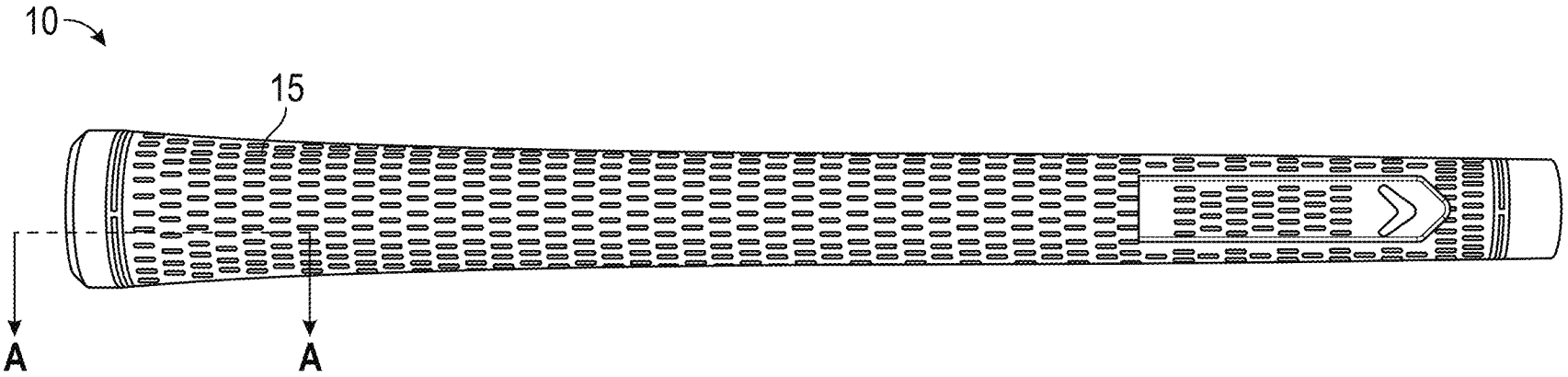
FIG. 1 is a side plan view of a golf club shaft.

The present invention is directed to golf club shafts with removable counterbalance weights, which are particularly useful when used in connection with putters. The counterbalance weight configurations of the present invention permit golfers to easily and quickly change their club weighting whenever and wherever they wish, including, but not limited to, at the practice range, the golf course, and their home. Each of the embodiments disclosed herein, when fully assembled with a grip 15, appear as shown in FIG. 1.

Figure 2:
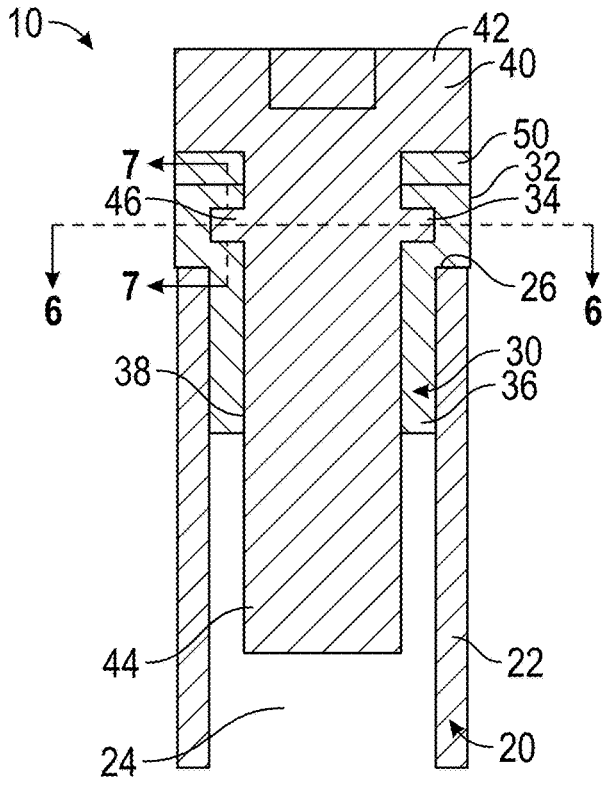
FIG. 2 is a cross-sectional view of the golf club shaft shown in FIG. 1 taken along lines A-A according to a first embodiment of the present invention.
Figure 6:
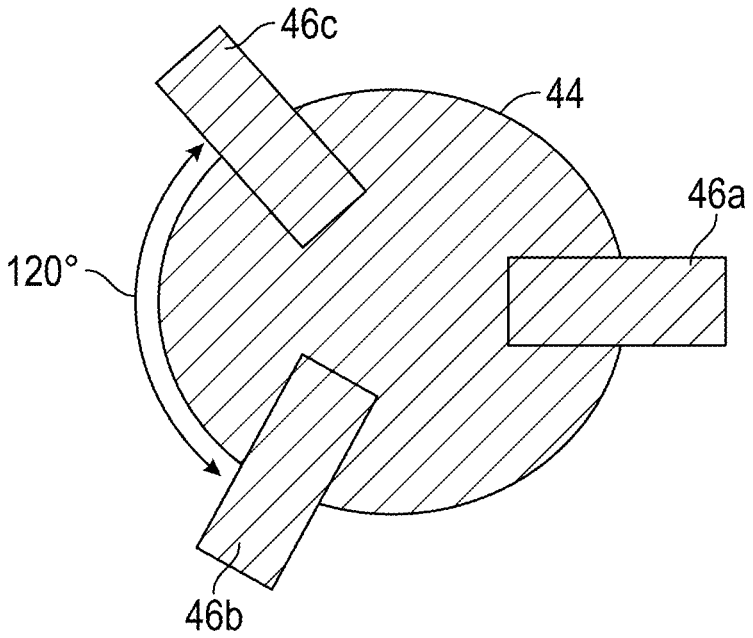
FIG. 6 is a cross-sectional view of the golf club shaft shown in any of FIGS. 2-5 taken along lines 6-6.
Figure 7:
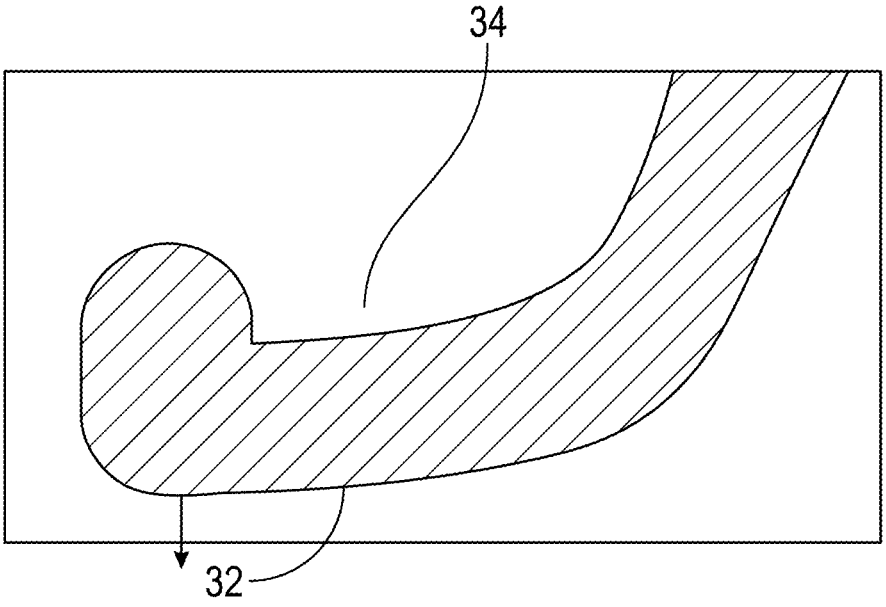
FIG. 7 is a cross-sectional view of the golf club shaft shown in any of FIGS. 2-5 taken along lines 7-7.

A first, preferred embodiment of the present invention is shown in FIGS. 2 and 6-7. In this embodiment, the assembly 10 comprises a shaft 20, a shaft sleeve 30, a weight 40, and a disc spring 50. The shaft 20 has a wall 22 with an overall diameter ranging from 0.595 to 0.605 inch, a hollow interior 24 with a diameter ranging from 0.510 to 0.517 inch, and a butt end 26. The sleeve 30 comprises a head portion 32 comprising a notch 34, an extension portion 36, and a hollow through-hole 38. The weight 40 comprises a head portion 42, an elongated extension portion 44, and a plurality of tines 46*a*, 46*b*, 46*c* extending radially from the elongated extension portion 44, each spaced approximately 120° from its neighbors.

As shown in FIG. 2, the extension portion 36 of the sleeve 30 is bonded to the shaft wall 22 within the hollow interior 24 at the butt end 26. The weight 40 is removably affixed to the shaft sleeve 30 by inserting the elongated extension portion 44 into the through-hole 38 and flexing the head portion 32 of the sleeve 30 open so that the tines 46*a*, 46*b*, 46*c* can fit within the notch 34. The disc spring 50 is disposed between the head portion 32 of the sleeve and the head portion 42 of the weight 40 and helps to snugly secure the weight 40 to the shaft sleeve 30 by pressing against the underside of the head portion 42. When a user wishes to remove the weight 40, they can pull the head portion 32 of the sleeve 30 open so that the tines 46*a*, 46*b*, 46*c* can be removed from the notch 34.

Figure 3:
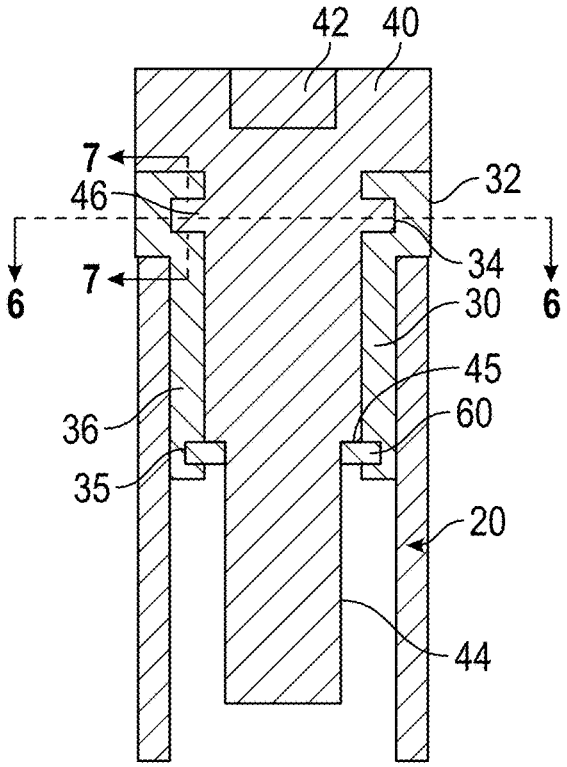
FIG. 3 is a cross-sectional view of the golf club shaft shown in FIG. 1 taken along lines A-A according to a second embodiment of the present invention.

The second embodiment, shown in FIGS. 3 and 6-7, has many of the same features as the preferred embodiment, except that instead of a disc spring 50, a spring c-clip 60 is inserted into a lower groove 35 at the bottom end of the extension portion 36 of the sleeve 30. The elongated extension portion 44 of the weight 40 comprises a shelf or lip 45 that rests against the spring c-clip 60 when the weight 40 is fully engaged with the shaft sleeve 30, and the spring c-clip 60 places pressure on the shelf 45 such that, when the head portion 32 of the sleeve 30 is flexed open to remove the tines 46 from the notch 34, the weight is pushed upwards away from the shaft 20.

Figure 4:
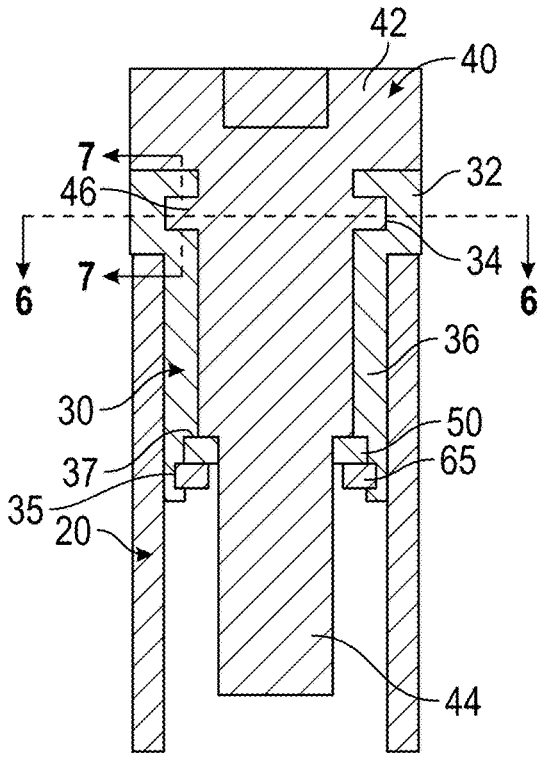
FIG. 4 is a cross-sectional view of the golf club shaft shown in FIG. 1 taken along lines A-A according to a third embodiment of the present invention.

The third embodiment, shown in FIGS. 4 and 6-7, has most of the same features as the second embodiment, except that the extension portion 36 of the sleeve 30 has a shelf 37 disposed directly above the lower groove 35, into which a disc spring 50 is placed. Instead of a spring c-clip 60, a regular c-clip 65 is placed into the lower groove, effectively sandwiching the disc spring 50 between the c-clip 65 and the shelf 37. The disc spring 50 places pressure on the shelf 45 of the weight 40 to assist in its removal from the shaft 20 when the head portion 32 of the sleeve 30 is flexed open to remove the tines 46 from the notch 34.

Figure 5:
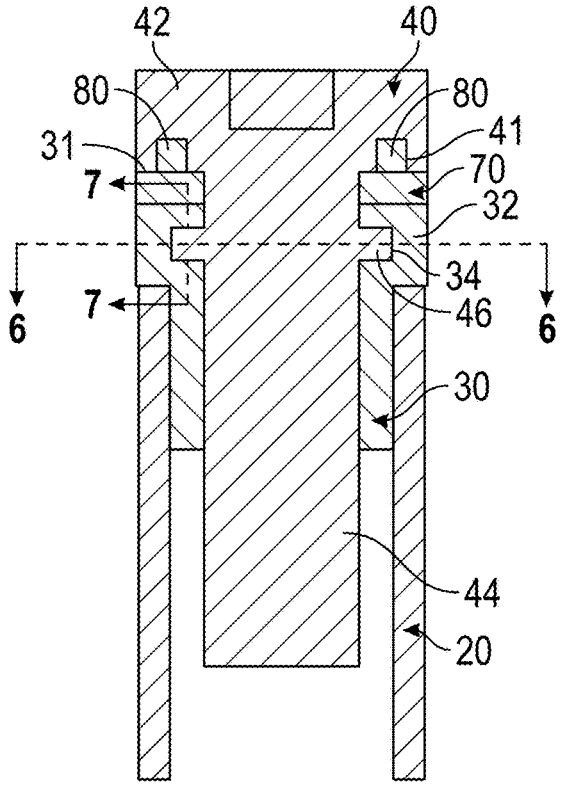
FIG. 5 is a cross-sectional view of the golf club shaft shown in FIG. 1 taken along lines A-A according to a fourth embodiment of the present invention.

In a fourth embodiment, shown in FIGS. 5-7, the weight 40 is retained within the sleeve 30 with magnetic parts instead of disc springs 50 or spring c-clips 60. As shown in FIG. 5, the fourth embodiment has many of the same features as the first embodiment, except that the disc spring 50 is replaced with one or more anchoring magnets 70 that are affixed (via adhesive or other means known to a person skilled in the art) to an upper surface 31 of the sleeve 30 head portion 32. The head portion 42 of the weight 40 comprises a lower groove or indent 41 into which one or more securing magnets 80 are affixed, via adhesive or other means known to a person skilled in the art. The magnets 70, 80 are attracted to one another and provide enough force to help secure the weight 40 within the sleeve 30 and shaft 20.

The fifth through tenth embodiments of the present invention differ from the preceding embodiments in that there is no tine 46/groove 34 structure for retaining the weight 40 within the shaft sleeve 30.

In the fifth, sixth, and seventh embodiments, the weight 40 is made from a ferrous material. For example, in the fifth embodiment, shown in FIG. 8, the structure is similar to that of the fourth embodiment, except that there is no need for securing magnets 80, as the weight 40 is attracted to the anchoring magnet 70 by virtue of its ferrous properties. The sixth embodiment, shown in FIG. 9, is similar to the fifth embodiment, except that the anchoring magnet 70 is embedded within an upper groove 33 disposed within the upper surface 31 of the sleeve 30 head portion 32. In the seventh embodiment, shown in FIG. 10, the sleeve 30 itself is a magnet, thereby making a separate anchoring magnet 70 unnecessary.

Figure 11:
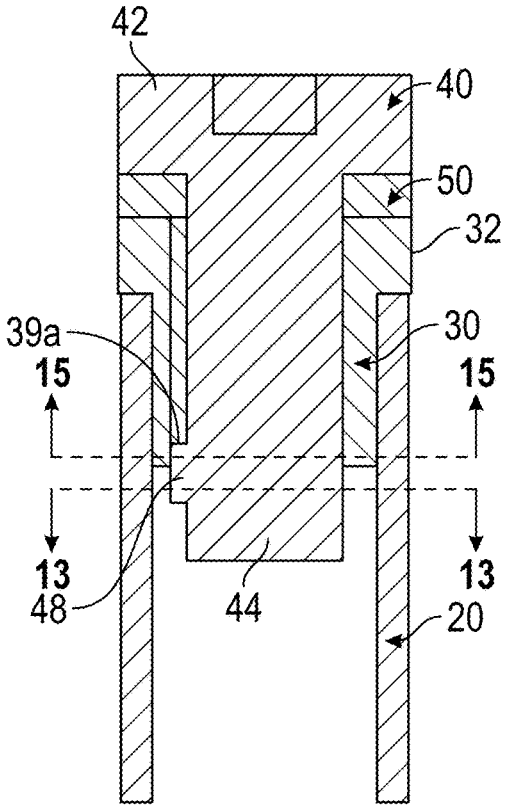
FIG. 11 is a cross-sectional view of the golf club shaft shown in FIG. 1 taken along lines A-A according to an eighth embodiment of the present invention.
Figure 12:
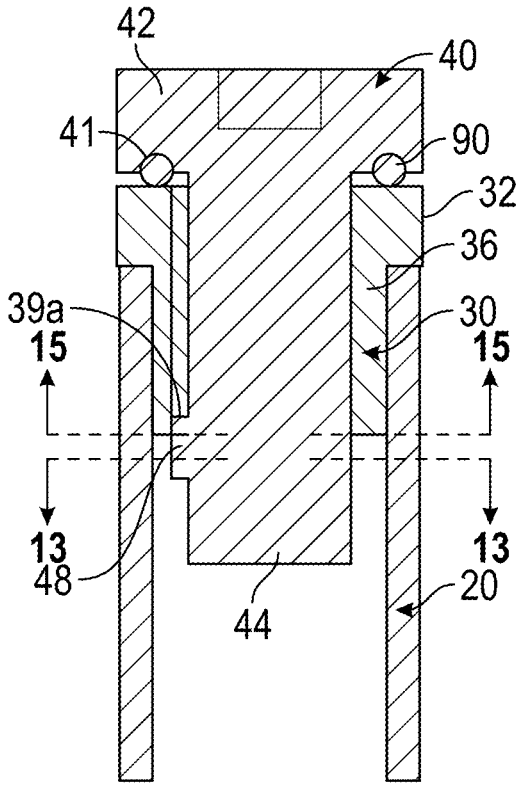
FIG. 12 is a cross-sectional view of the golf club shaft shown in FIG. 1 taken along lines A-A according to a ninth embodiment of the present invention.
Figure 13:
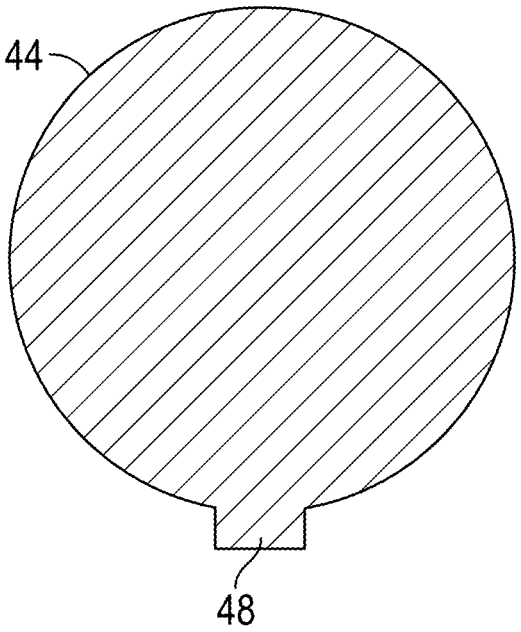
FIG. 13 is a cross-sectional view of the golf club shaft shown in any of FIGS. 11-12 taken along lines 13-13.
Figure 14A:
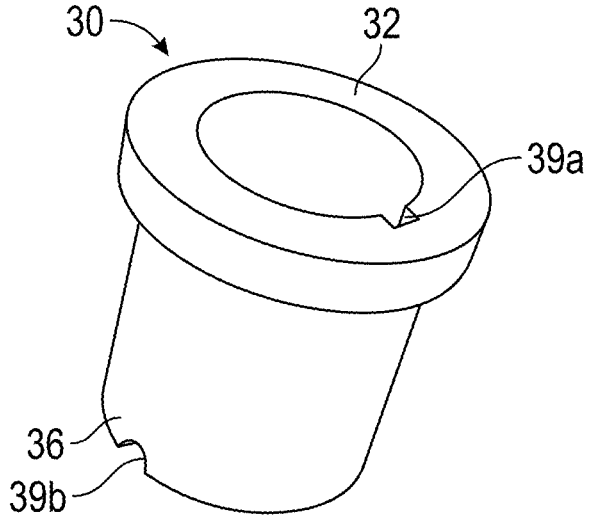
FIGS. 14A and 14B are side perspective views of the shaft sleeve shown in FIGS. 11-12.
Figure 14B:
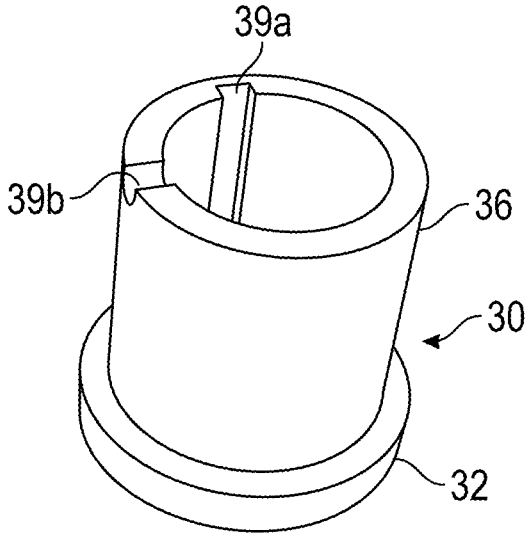
Figure 15:
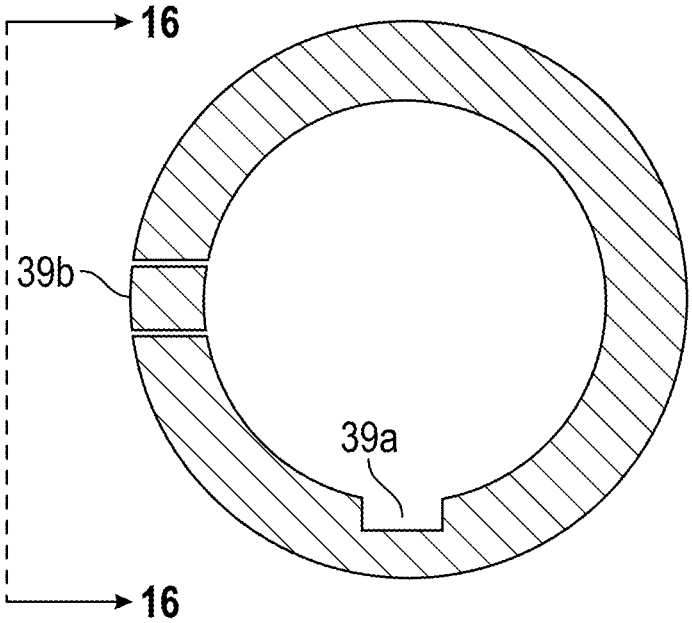
FIG. 15 is a cross-sectional view of the golf club shaft shown in any of FIGS. 11-12 taken along lines 15-15.
Figure 16:
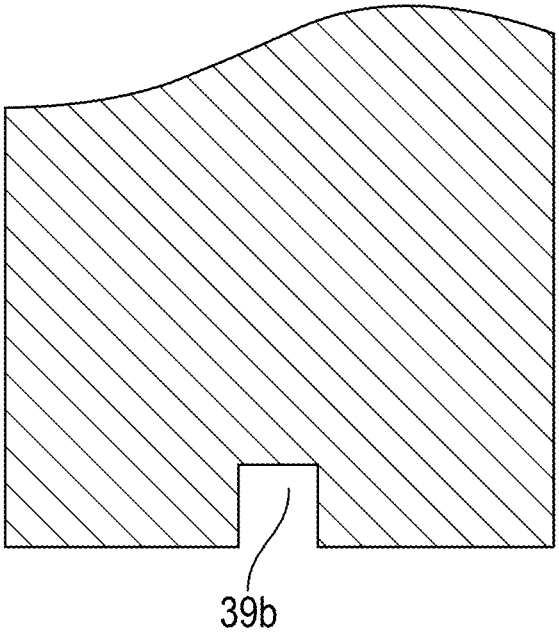
FIG. 16 is a side view of the embodiment shown in FIG. 15 viewed along lines 16-16.

An eighth embodiment is shown in FIGS. 11 and 13-16. In this embodiment, the shaft sleeve 30 has first and second locking notches 39*a*, 39*b*. The first locking notch 39*a* extends the entire length of the sleeve 30, from the head portion to the end of the extension portion 36, facing the through-hole 38, while the second locking notch is disposed only at the end of the extension portion 36. The weight 40 includes a keyed portion 48 disposed proximate the end of the elongated extension portion 44, the keyed portion 48 sized to fit within and slide through the first locking notch 39*a* when the elongated extension portion 44 is inserted into the through-hole 38 of the sleeve 30. When the keyed portion 48 exits the through-hole 38, the weight is turned ninety degrees so that the keyed portion 48 fits within the second locking notch 39*b*, which secures the weight within the sleeve 30 and prevents it from being pulled out without being turned so that the keyed portion 48 can enter the first locking notch 39*a* again. In this embodiment, pressure may be placed on the head portion 42 of the weight 40 with a disc spring 50 to prevent the weight 40 from rattling, moving, or twisting, as shown in FIG. 11, or the weight 40 made be made of a ferrous material and an anchoring magnet 70 may be affixed to the head portion 32 of the sleeve 30, as described above to further secure the weight 40 within the sleeve. In a ninth embodiment, shown in FIG. 12, an o-ring 90 helps secure the weight 40 instead of a disc ring 50 or magnet 70. The head portion 42 of the weight 40 may include a groove or indent 41 to receive the o-ring 90

Figure 17:
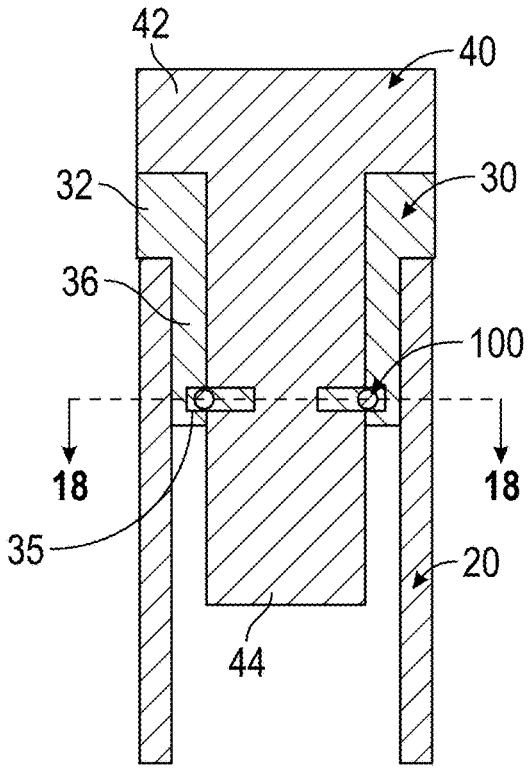
FIG. 17 is a cross-sectional view of the golf club shaft shown in FIG. 1 taken along lines A-A according to a tenth embodiment of the present invention.
Figure 18:
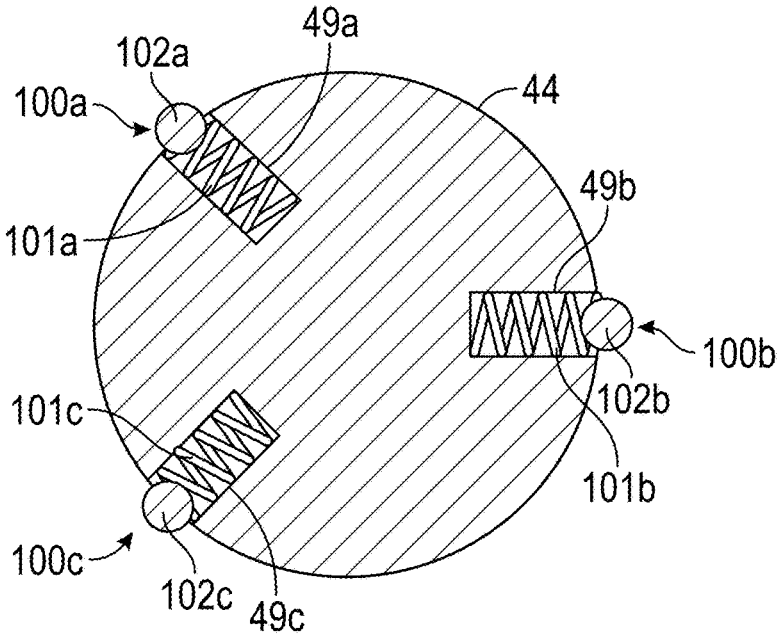
FIG. 18 is a cross-sectional view of the embodiment shown in FIG. 17 taken along lines 18-18.

A tenth embodiment of the present invention is shown in FIGS. 17-18. In this embodiment, the sleeve 30 includes a lower groove 35, and the elongated extension portion 44 of the weight 40 includes a plurality of indents or notches 49*a*, 49*b*, 49*c*, each spaced approximately 120° from its neighbors. In an alternative embodiment, there may be two notches 49*a*, 49*b* spaced approximately 90° apart, or even just one notch 49*a*. A detent ball and spring 100*a*, 100*b*, 100*c* is disposed in each notch 49*a*, 49*b*, 49*c*, with the spring portion 101*a*, 101*b*, 101*c* disposed within the notch 49*a*, 49*b*, 49*c*, and the ball portion 102*a*, 102*b*, 102*c* protruding from the notch 49*a*, 49*b*, 49*c*. When the elongated extension portion 44 is inserted into the through-hole 38 of the sleeve 30, the detent ball and springs 100*a*, 100*b*, 100*c* are compressed inwards, allowing the elongated extension portion 44 to slide within the sleeve 30. When the detent ball and springs 100*a*, 100*b*, 100*c* encounter the lower groove 35, they expand such that the ball portions 102*a*, 102*b*, 102*c* slide into the lower groove 35 and prevent the weight 40 from being extracted from the sleeve 30.

Figure 8:
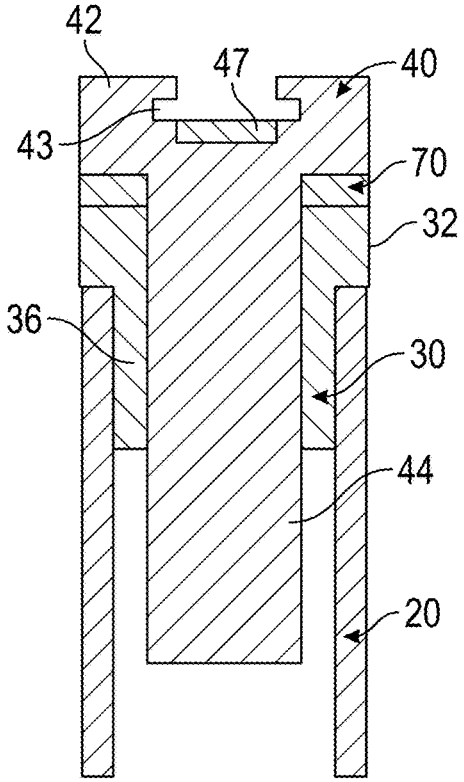
FIG. 8 is a cross-sectional view of the golf club shaft shown in FIG. 1 taken along lines A-A according to a fifth embodiment of the present invention.
Figure 9:
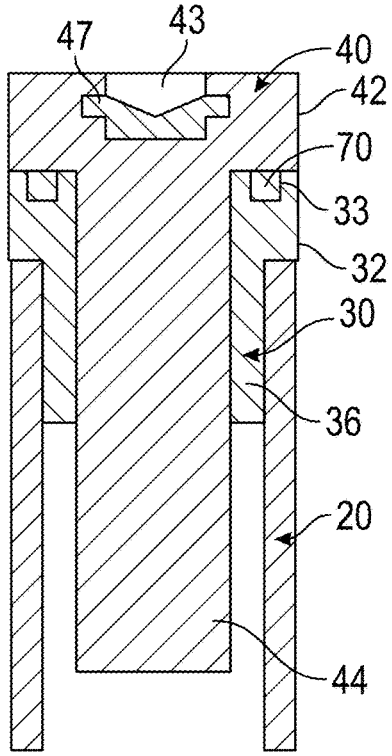
FIG. 9 is a cross-sectional view of the golf club shaft shown in FIG. 1 taken along lines A-A according to a sixth embodiment of the present invention.
Figure 10:
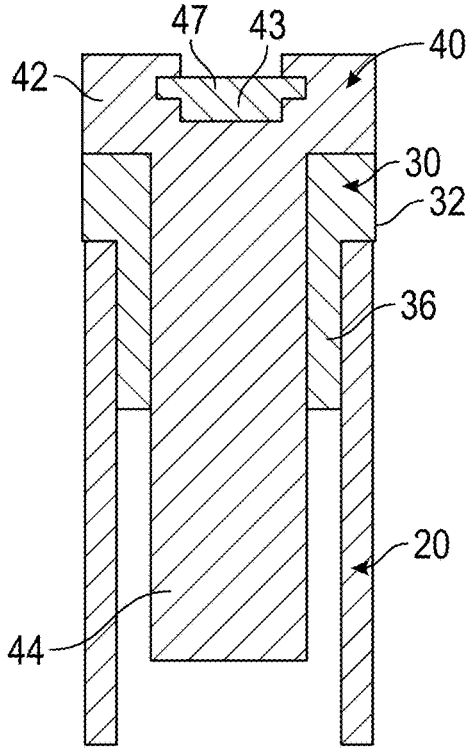
FIG. 10 is a cross-sectional view of the golf club shaft shown in FIG. 1 taken along lines A-A according to a seventh embodiment of the present invention.

In any of the embodiments disclosed herein, the head portion 42 of the weight may include a socket 43 sized to receive a secondary weight 47 or filler material to allow for further weight adjustability, as shown in FIGS. 8-10. The weight 40 may be composed of a high-density material, including tungsten, and the shaft sleeve 30 may be composed of any material, but preferably a lower-density material such as aluminum alloy or plastic or carbon composite.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim:

1. An assembly comprising:

a shaft comprising a shaft wall, a hollow interior, and a butt end;

a shaft sleeve comprising a first head portion with a notch, a first extension portion with a groove, and a hollow through-hole;

a weight comprising a second head portion, a second extension portion with a shelf, and a plurality of tines extending radially from the elongated extension portion; and a spring c-clip;

wherein the first extension portion is disposed within the hollow interior and bonded to the shaft wall so that the first head portion abuts the butt end of the shaft, wherein the second extension portion is disposed within the hollow through-hole so that each of the plurality of tines aligns with and fits within the notch, wherein the spring c-clip is disposed within the groove so that it encircles the second extension portion and abuts the shelf.

2. The assembly of claim 1, wherein the plurality of tines comprises three tines, and wherein each of the three tines is spaced approximately 120° from the other two tines.

3. The assembly of claim 1, wherein the weight can be removed from the shaft sleeve by pulling the head portion of the sleeve apart so that the plurality of tines can be removed from the notch.

4. The assembly of claim 1, wherein the shaft has a diameter ranging from 0.595 to 0.605 inch.

5. The assembly of claim 1, wherein the hollow through-hole has a diameter ranging from 0.510 to 0.517 inch.

6. The assembly of claim 1, wherein the spring c-clip places pressure on the shelf.

* * * * *